US010280708B2

(12) United States Patent
Lamb et al.

(10) Patent No.: US 10,280,708 B2
(45) Date of Patent: May 7, 2019

(54) FLOW CONTROL VALVE WITH BALANCED PLUNGER

(71) Applicant: Schlumberger Technology Corporation, Sugar Land, TX (US)

(72) Inventors: Justin David Elroy Lamb, Arcola, TX (US); John Algeroy, Houston, TX (US); Hy Phan, Houston, TX (US); Curtis Ardoin, Manvel, TX (US); Arunkumar Arumugam, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 49 days.

(21) Appl. No.: 15/233,501

(22) Filed: Aug. 10, 2016

(65) Prior Publication Data

US 2017/0044867 A1 Feb. 16, 2017

Related U.S. Application Data

(60) Provisional application No. 62/204,732, filed on Aug. 13, 2015.

(51) Int. Cl.

| | |
|---|---|
| ***E21B 34/06*** | (2006.01) |
| ***E21B 34/08*** | (2006.01) |
| ***E21B 34/10*** | (2006.01) |
| *E21B 43/14* | (2006.01) |
| *E21B 43/04* | (2006.01) |

(52) U.S. Cl.

CPC ..... *E21B 34/066* (2013.01); *E21B 34/08* (2013.01); *E21B 34/101* (2013.01); *E21B 43/04* (2013.01); *E21B 43/14* (2013.01)

(58) Field of Classification Search

CPC ..... E21B 34/066; E21B 34/101; E21B 34/08
See application file for complete search history.

(56) References Cited

U.S. PATENT DOCUMENTS

| | | | | |
|---|---|---|---|---|
| 2010/0012872 | A1* | 1/2010 | Hartwell | E21B 34/066 251/129.15 |
| 2014/0198617 | A1* | 7/2014 | Noui-Mehidi | E21B 47/04 367/81 |
| 2014/0338922 | A1* | 11/2014 | Lopez | E21B 34/066 166/373 |
| 2015/0027724 | A1* | 1/2015 | Symms | E21B 34/16 166/373 |

* cited by examiner

*Primary Examiner* — D. Andrews
*Assistant Examiner* — Kristyn A Hall

(57) ABSTRACT

A flow control valve assembly with a plunger continuously movable between closed, intermediate, and open positions. The plunger has an uphole side and a downhole side opposite the uphole side, and both uphole and downhole sides are exposed to the same hydrostatic pressure in the well, resulting in a flow control device that can be operated with minimal power consumption and still withstanding high pressure loads.

19 Claims, 4 Drawing Sheets

FLOW CONTROL VALVE WITH BALANCED PLUNGER

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. One such component is a flow control valve used to control the amount of fluid permitted to flow upward through the completion to the surface.

SUMMARY

Embodiments of the present disclosure are directed to a flow control valve assembly including a plunger containment member and a plunger operatively coupled to the plunger containment member such that moving the plunger toward an uphole side and toward a downhole side opposite the uphole side in the plunger containment member causes the flow control valve to selectively open and close in response to administration of force to the plunger. The uphole side of the plunger and the downhole side of the plunger are exposed to a hydrostatic pressure of substantially equal magnitude. The assembly also includes a first seal between the plunger and the plunger containment member on the uphole side and a second seal between the plunger and the plunger containment member on the downhole side.

The assembly can also include a power module to provide power to move the plunger to selectively open and close the flow control valve. The first and second seals are able to withstand 1,200 psi and the power module is configured to operate with between 8-10 watts.

Further embodiments of the present disclosure are directed to a method for operating a flow control device. The method includes providing a flow control valve in a well, the flow control valve having a plunger containment member, a plunger, and a fluid port. The plunger is configured to travel forward and backward in the plunger containment member to open and close the flow control valve. The plunger has a first side and a second side opposite the first side. Both the first and second sides are exposed to pressure in the well of substantially equal magnitude, and the fluid port is opened or closed by moving the plunger within the plunger containment member. The method also includes providing a first seal for the first side of the plunger and a second seal for the second side of the plunger. The first and second seals are configured to withstand up to 1,200 psi. The method further includes operating a power module to move the plunger in the plunger containment member, wherein the power module consumes no more than 10 watts of power.

Still further embodiments of the present disclosure are directed to a flow control device for use in a downhole completion. The flow control device includes a central fluid bore configured to conduct fluid upward from the well, the central fluid bore having a fluid port in a wall of the bore, and a plurality of sand screens positioned outside the central bore and configured to filter fluid as the fluid passes through the sand screens. The device also includes an annular bore configured to receive fluid after passing through the sand screens. The annular bore is fluidly connected to the fluid port in the central fluid bore. There is also a plunger positioned in the annular bore and configured to selectively block fluid flow from the annular bore into the central bore. The plunger is selectively, continuously movable between a closed position, an intermediate position, and a fully open position, the plunger having a downhole side and an uphole side opposite the downhole side, wherein the uphole side and downhole sides are both exposed to substantially the same hydrostatic pressure in the well. The device also includes a seal assembly between the plunger and the uphole side.

DETAILED DESCRIPTION

Figure 1:
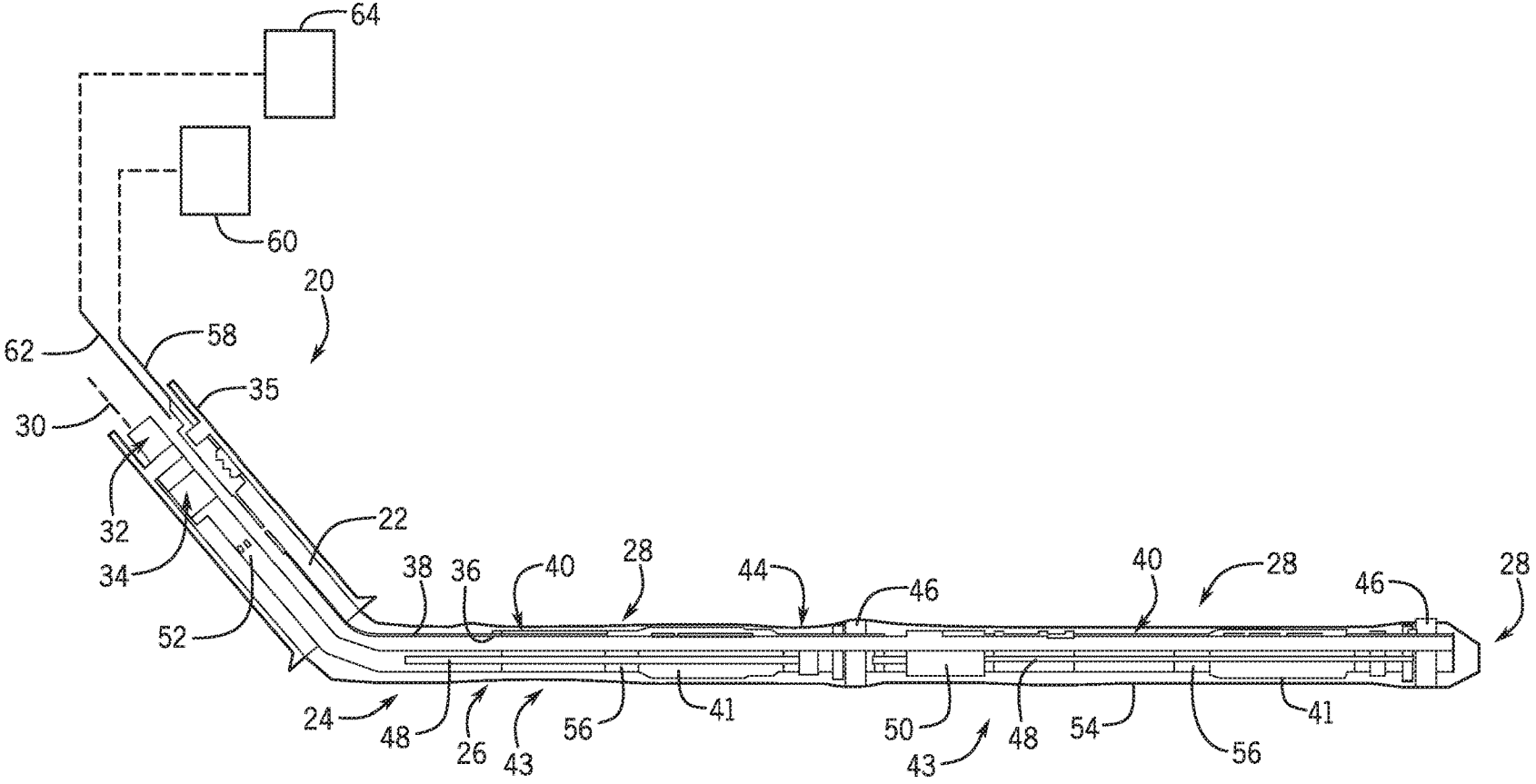
FIG. 1 is an illustration of an example of a completion deployed in a lateral wellbore and combined with a multi-zone control system, according to an embodiment of the disclosure.

In the following description, numerous details are set forth to provide an understanding of the present disclosure. However, it will be understood by those skilled in the art that the embodiments of the present disclosure may be practiced without these details and that numerous variations or modifications from the described embodiments may be possible.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to an electrically controllable, multi-zone control system. The multi-zone control system may be used for controlling the inflow of fluids into a completion, e.g. a lateral completion, at a plurality of well zones. According to an embodiment, hydraulically actuated, flow control devices are distributed along the completion in the various well zones. Additionally, a control module is positioned between the flow control devices, e.g. in a middle region of the completion. For example, the control module may be positioned between well zones and operated downhole for controlling flow control devices uphole and downhole relative to the location of the control module.

The control module is supplied with hydraulic actuating fluid from a source, such as a downhole hydraulic fluid source or a surface source. In operation, the control module is electrically controllable to enable selective distribution of the hydraulic actuating fluid to specific flow control devices, e.g. flow control devices in a specific well zone. The control module may be actuated via electric signals to provide controlled distribution of hydraulic actuating fluid under pressure to selected flow control devices. The hydraulic actuating fluid is used to shift the selected flow control devices to a desired open or closed flow position allowing or blocking flow from the surrounding well zone.

Effectively, the control module serves as a multi-zone distribution hub. In some embodiments, the control module is supplied with hydraulic actuating fluid via a single hydraulic control line and a pump is used to place the actuating fluid under suitable pressure for actuating the flow control devices. An electric line may be routed downhole to the control module to provide electrical control signals to the control module. Based on those control signals, the control module is actuated to direct hydraulic actuating fluid through relatively short hydraulic lines to specific flow control devices. As a result, electrical signals supplied through, for example, a single electric line may be routed downhole and used to ultimately control operation of flow control devices in a plurality of well zones, e.g. 2-5 well zones. Use of the electric line enables and simplifies active surface control of fluid flow into the completion at a plurality of downhole well zones. The use of electrical control signals also enhances the ability to multi-drop such a system to various other well zones.

Referring generally to FIG. 1, an embodiment of a well system 20 is illustrated. In this embodiment, well system 20 is deployed in a wellbore 22 having a lateral wellbore section 24, e.g. a generally horizontal wellbore section. The well system 20 comprises a completion 26 deployed in wellbore 22. In a variety of applications, completion 26 may be in the form of a lateral completion deployed in lateral wellbore section 24 along a plurality of well zones 28.

In some applications, the lateral completion 26 is a lower completion initially installed downhole and then coupled with an upper completion 30 (shown in dashed lines) via a connect-disconnect system 32. An artificial lift system, e.g. an electric submersible pumping system, may be deployed as part of or in cooperation with the upper completion 30 to produce fluids received via lateral completion 26. During a production operation, the lateral wellbore section 24 may be isolated via a packer 34, such as a production packer, set against a surrounding casing 35.

Lateral completion 26 comprises an interior flow region or passage 36 which may be along the interior of a base pipe 38. The lateral completion 26 also comprises a plurality of sand screens 40 disposed about the base pipe 38 and located in corresponding well zones 28. Additionally, the lateral completion 26 comprises a plurality of flow control device systems 41. Each flow control device system 41 may comprise a plurality of flow control devices 42 located in each well zone 28, as further illustrated in FIG. 2. In a variety of applications, the lateral completion 26 is assembled by connecting sections which may be referred to as joints 43. For example, sand screen assembly joints 43 may be sequentially joined and deployed along lateral wellbore 24.

Figure 2:
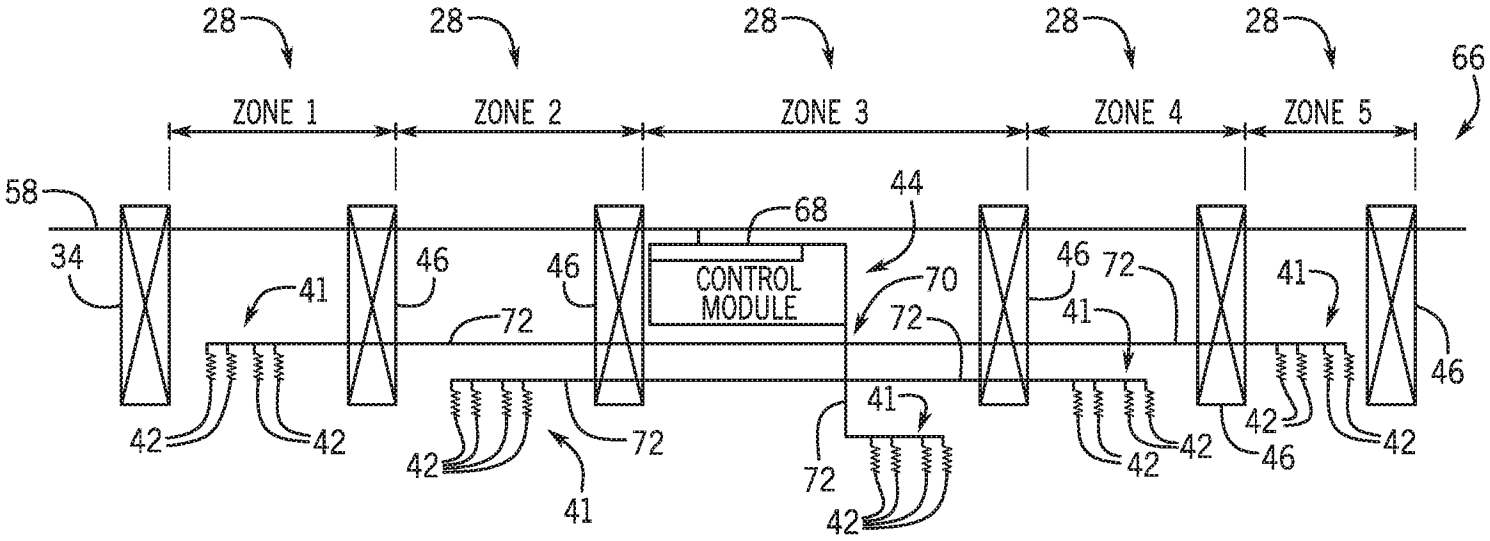
FIG. 2 is a schematic illustration of an example of a multi-zone control system utilizing a control module combined with a plurality of flow control devices, according to an embodiment of the disclosure.

Referring generally to FIGS. 1 and 2, the flow control devices 42 are uniquely controlled via a control module 44. The control module 44 effectively enables control of fluid flow from an exterior of lateral completion 26 to an interior of lateral completion 26 at specifically selected well zones 28. In a variety of applications, the control module 44 may be located between sand screens 40 and between well zones 28, e.g. at a generally central or middle location with respect to the plurality of well zones 28. In other words, the control module 44 may be positioned such that at least some of the flow control devices 42 are uphole and at least some of the flow control devices 42 are downhole relative to the location of the control module 44. It should be noted uphole refers to the side of the module 44 toward the surface regardless of whether the lateral wellbore 24 is horizontal or inclined. The downhole side of control module 44 is the opposite side which is farther into the wellbore relative to the control module. The well zones 28 may be separated and isolated via isolation packers 46 which are deployed in an un-set state and then set against the surrounding open hole wellbore wall, as illustrated.

To facilitate an initial gravel packing of lateral wellbore 24 after setting of the packers 46, the completion 26 also may comprise a plurality of shunt tubes 48 which deliver the gravel packing slurry to sequential well zones 28. The shunt tubes extending through sequential well zones 28 may be joined at a shunt tube isolation valve structure 50 having valves for controlling the flow of gravel slurry. The valves in valve structure 50 serve to further isolate adjacent well zones 28 when the valves are closed, e.g. closed after gravel packing. During a gravel packing operation, gravel packing slurry is delivered downhole by a service tool and then diverted from the inside diameter to the annulus surrounding completion 26 via a port closure sleeve 52. The gravel slurry flows along the annulus and shunt tubes 48 to form a uniform gravel pack 54.

In an operational example, the gravel slurry begins packing from the heel of the well and as the gravel/sand settles the dehydration fluid travels along a drainage layer between the first sand screen 40 and a solid section of the base pipe 38. The dehydration fluid travels along this fluid return path until reaching a first sliding sleeve 56 of a plurality of sliding sleeves. In some applications, some of the returning dehydration fluid also flows through the corresponding flow control device system 41, thus reducing or removing the use of additional sliding sleeves 56. The dehydration fluid then flows into interior 36 and back to the surface through the base pipe 38 and corresponding tubing. Upon completion of the heel zone, the gravel slurry pumping operation is continued and this process is repeated at subsequent well zones 28, with the aid of shunt tubes 48, until screen out pressure is reached and the pumps are stopped.

Once the service tool is retrieved, the upper completion 30 is deployed downhole and engaged with the lower completion 26 to establish communication from the surface to the lower completion 26. For example, electrical and/or hydraulic communication may be established through the connect-disconnect 32 which can be in the form of an electrically powered connect-disconnect system. Electrical power and electrical control signals may be provided to the control module 44 via an electric line 58 routed through the connect-disconnect 32. The electric line 58 may be coupled with a control system 60, e.g. a computer-based control system, located at the surface or at another suitable location.

In some applications, hydraulic actuating fluid may be provided to control module 44 via a hydraulic line 62 to enable selective actuation of the flow control devices 42. The hydraulic line 62 may similarly be routed through the connect-disconnect 32 and coupled with a hydraulic pump and control system 64 located at the surface or at another suitable location. In other embodiments, however, the hydraulic line 62 may be routed to control module 44 from a downhole fluid reservoir as described in greater detail below.

It should be noted the electric line 58 may comprise a single or multiple conductive paths for carrying electrical power, control signals, and/or data signals, e.g. data signals from sensors or other downhole equipment. By way of example, the electric line 58 may be in the form of a single line having a plurality of conductors able to independently carry power and/or data signals between, for example, surface control 60 and control module 44. Similarly, the hydraulic line 62 may comprise a single flow path or a plurality of flow paths for carrying hydraulic actuation fluid.

Referring again to FIG. 2, a schematic illustration is provided of an embodiment of an overall multi-zone control system 66 in which the control module 44 is electrically controlled via electrical control line 58 and serves as a multi-zone distribution hub. In this embodiment, sequential well zones 28 are isolated via packers 46 and the control module 44 is located proximate a generally central well zone 28. The control module 44 may comprise control electronics 68, e.g. a controller, which receive electrical control signals via electric line 58. The electronics 68 may comprise control and telemetry features, and it may be embodied in a printed circuit board or otherwise suitably configured in control module 44.

Based on the control signals received via electric line 58, the controller 68 executes flow control according to the instructions carried by the control signals. For example, the controller 68 may be used to control operation of a hydraulic manifold 70 of control module 44. As described in greater detail below, the hydraulic manifold 70 may comprise a variety of electrically controllable valves which are actuated according to instructions carried by the electrical control signals. The control module 44/manifold 70 are thus selectively controlled to direct flows of actuating fluid to the appropriate flow control system 41 and corresponding control devices 42 via a corresponding hydraulic line or lines 72.

In some embodiments, each hydraulic line 72 is routed to a corresponding well zone 28 and controls the simultaneous opening or closing of the group of flow control devices 42 in that specific corresponding well zone 28. For example, control instructions may be provided by control system 60 to controller 68 of control module 44 via appropriate electrical signals sent along electric line 58. In response to those instructions, the control module 44 controls hydraulic manifold 70 to ensure a flow of hydraulic actuating fluid to the appropriate flow control devices 42 in a given well zone or zones 28. Accordingly, if undesirable fluid, e.g. water or undesirable gas, begins to flow into the interior 36 of lateral completion 26 at a specific well zone 28, the group of flow control devices 42 in that particular well zone 28 may be closed to block further inflow.

Depending on the type of surrounding formation and equipment used to construct lower completion 26, the number and length of well zones 28 may vary. By way of example, the well zones 28 may be approximately 1000 feet in length and control module 44 may be used to control 2-5 well zones 28. However, the lengths of well zones 28 may range from a few feet to thousands of feet, and the length may be the same or dissimilar from one well zone 28 to the next. Accordingly, the number of flow control devices 42 placed in each well zone 28 also may vary according to the parameters of a given application.

In the specific example illustrated, the overall multi-zone control system 66 employs control module 44 to control well fluid flow at five different well zones 28. Sometimes the number of well zones 28 controlled by an individual control module 44 may be selected based on the number of control line feed throughs available at isolation packers 46. For example, if the isolation packers 46 have three control line feed throughs, then the number of well zones 28 serviced by the control module 44 may be selected based on the ability to accommodate the single electrical line 58 and a pair of hydraulic lines 72. If the number of feed throughs in isolation packers 46 is increased, however, the multi-drop to other well zones 28 can also be increased accordingly. Also, the electric line 58 may be routed to additional control modules 44 so as to enable further control over inflow of well fluids at additional well zones 28.

Figure 3:
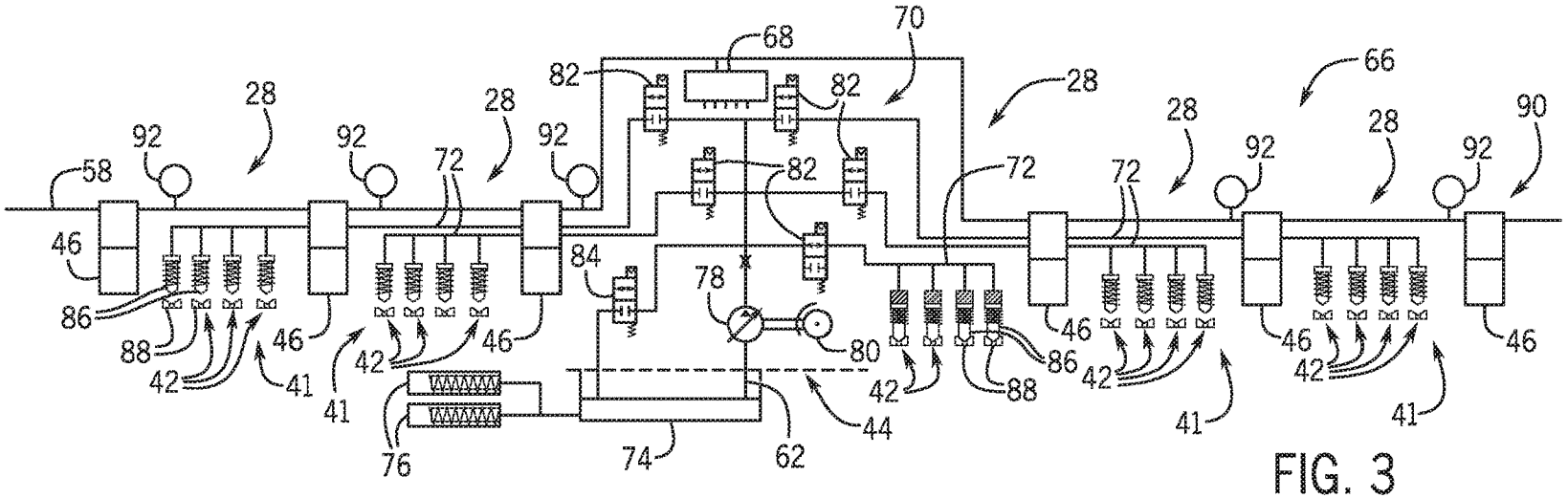
FIG. 3 is a schematic illustration of another example of a multi-zone control system utilizing a control module combined with a plurality of flow control devices, according to an embodiment of the disclosure.

Referring generally to FIG. 3, another embodiment of multi-zone control system 66 is illustrated. In this example, the control module 44 is supplied with hydraulic actuating fluid from a downhole reservoir 74 which may be pressure compensated via one or more compensators 76. For example, the downhole reservoir 74 may serve as a hydraulic fluid bank for storing hydraulic actuating fluid downhole in a closed loop while being reservoir pressure or tubing pressure compensated via compensators 76.

The downhole reservoir 74 supplies hydraulic actuating fluid to control module 44 via hydraulic line 62. In the embodiment illustrated, control module 44 comprises a hydraulic pump 78 powered by a motor 80 which, in turn, may be coupled to electrical power via electric line 58. In some embodiments, the hydraulic pump 78 and the motor 80 may be combined into a single component. In the illustrated example, the hydraulic manifold 70 works in cooperation with a plurality of electrically actuated valves 82, e.g. solenoid operated valves, to control flow of hydraulic actuating fluid along hydraulic lines 72. An additional electrically actuated valve 84 may be used to enable circulation of hydraulic actuating fluid back to reservoir 74 when the electrically actuated valves 82 are closed to flow. This allows hydraulic pump 78 to continually operate and to simply return the pumped actuating fluid back to reservoir 74 when the electrically actuated valves 82 are in the closed position.

When the control module 44, e.g. controller 68, receives instructions to change the flow position of flow control devices 42 in a given well zone or zones 28, the appropriate valves 82 are shifted electrically to the desired flow or no-flow position. In the embodiment illustrated, the electrically actuated valve 84 has been shifted to the closed or no-flow position and one of the electrically controlled valves 82 has been shifted to the open flow position to enable flow of actuating fluid to the corresponding flow control devices 42. In the illustrated example, the valve 82 shifted to the open flow position has effectively directed actuating fluid under pressure to the flow control devices 42 in the middle well zone 28, thus shifting those flow control devices 42 to the closed flow position. When flow control devices 42 in the middle well zone 28 are closed, well fluids are prevented from flowing from the exterior of completion 26 to interior 36 at that well zone.

Depending on the application, flow control devices 42 may have a variety of configurations. By way of example, the flow control devices 42 may comprise plunger assemblies 86, e.g. hydraulically actuated plungers 86. In some applications, the plungers 86 are spring biased or otherwise biased to an open flow position allowing flow of fluids from an exterior to an interior of lateral completion 26. When hydraulic actuating fluid is allowed to flow to specific hydraulically actuated plungers 86 via manifold 70, those plungers 86 are forced against the spring bias and into corresponding seats 88 to block further flow of fluids therethrough.

In some embodiments, individual electrically actuated valves 82 may be coupled with flow control devices 42 in more than one well zone 28. In the embodiment illustrated in FIG. 3, for example, one of the electrically actuated valves 82 controls corresponding flow control devices 42 in two well zones 28 on the left or heel side of control module 44. Another one of the electrically actuated valves 82 controls the remaining flow control devices 42 in those same two well zones 28. Depending on the parameters of a given well, formation, well zone arrangement, equipment configuration, and/or other factors, various flow control arrangements may be selected. In the illustrated example, two of the electrically actuated valves 82 are actuated to the open flow position to close the corresponding groups of flow control devices 42 and to completely block flow in each of the heel side well zones 28.

A sensor system 90 also may be used to optimize control over fluid flow in each of the well zones 28. By way of example, the sensor system 90 may comprise a plurality of sensors 92 positioned along completion 26 and/or at other suitable locations within well zones 28. The sensors 92 may be in the form of pressure sensors, temperature sensors, or other sensors distributed throughout the well zones 28. The sensor data, e.g. pressure and temperature data, may be sent along electric line 58 to at least one of the controller 68 or control system 60 for processing. The processed data provides information that can be used for controlling flow into completion 26 at each well zone 28. For example, if the sensor data indicates the presence of water and/or gas, the flow control devices 42 for that well zone 28 may be closed to block further inflow of fluid.

Figure 4:
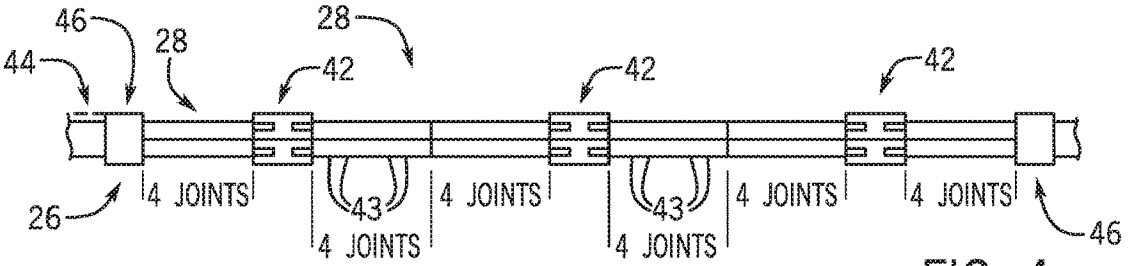
FIG. 4 is a schematic illustration of an example of lateral completion arrangement for use with a multi-zone control system, according to an embodiment of the disclosure.

Depending on the reservoir and surrounding formation, the lateral completion 26 may be constructed in various lengths and configurations. In FIG. 4, a schematic illustration is provided in which the lateral completion 26 is structured with a plurality of screen assembly joints 43, e.g. four screen assembly joints, on each side of a flow control device, e.g. flow control device 42. Consequently, a given flow control device(s) is able to collect fluid flow from the drainage layer in both uphole and downhole directions. For example, a given flow control device 42 may collect fluid flow from four uphole screen joints 43 and from four downhole screen joints. In the illustrated example, twenty four screen assembly joints 43 are disposed between the illustrated pair of isolation packers 46. Depending on the application, the number of joints 43 as well as a number of flow control devices 42 between isolation packers 46 may vary and may be selected based on, for example, zonal flow parameters. As described above, the inflow of well fluids is collected from the screens 40 and diverted along a drainage layer of the completion 26 to the flow control devices 42, e.g. to the plunger assemblies 86, to enable selective choking of production flow.

The overall zonal flow control system 66 may be adapted to a variety of applications and may be used to provide a low-cost, active control of multiple well zones 28, e.g. five well zones, from a single distribution hub/module 44. With additional feed throughs in packers 46 and in shunt tube isolation valve structures 50, additional well zones 28 may be controlled via module 44. The control module 44 serves as a distribution hub which can be multi-dropped to provide flow control in a plurality of well zones based on control signals through the simple electric line 58. In some applications, the hydraulic actuating fluid may be selectively diverted by the control module 44 to actuate other components in the lower completion 26, e.g. packers, sliding sleeves, or zonal isolation valves. The flow control devices 42 also may comprise various types of plunger assemblies which facilitate return flow through the sand screen assembly joints 43.

Depending on parameters of a given application, the control module 44 may be constructed in a variety of configurations and may comprise various features. Examples of such features include the integral pump 78 and the motor 80 used for hydraulic power generation. The control module 44 also may incorporate or work in cooperation with a pressure compensation system, e.g. compensators 76. In some applications, the control module may comprise or work in cooperation with an accumulator used for storing hydraulic energy. Additionally, electronics 68 may comprise various types of controllers and telemetry systems utilized for communication and for controlling the components of control module 44 and overall flow control system 66.

Other components of the overall well system and multi-zone flow control system 66 also may be adjusted according to the parameters of a given application. The electric line 58 may comprise separate lines for power and data or a combined power/data line. The control system 60 and electric line 58 may be used for carrying a variety of signals along a wholly hardwired electrical communication line or a partially wireless communication line. Such adjustments to the well system may be made according to equipment, environmental, and/or other considerations.

Figure 5:
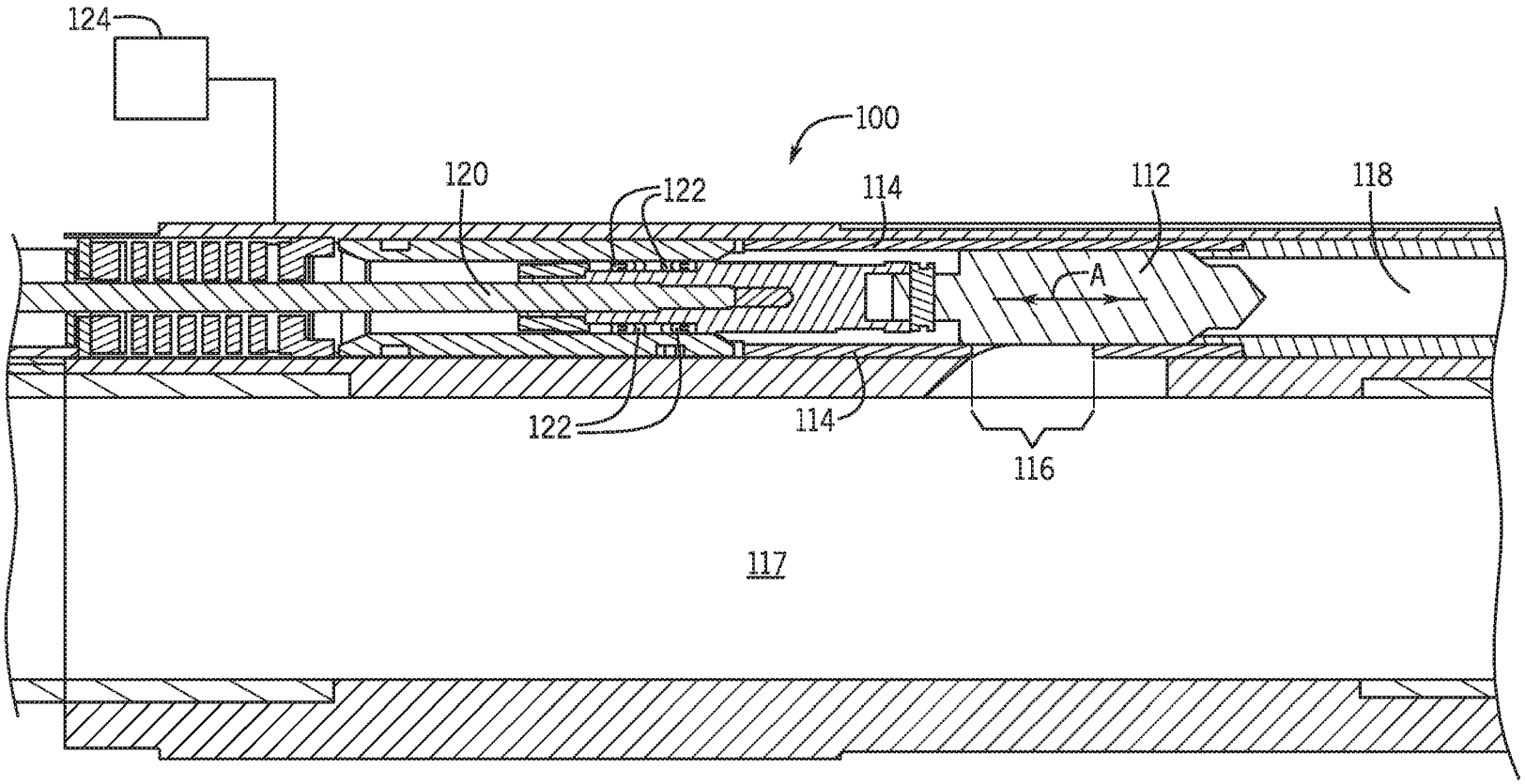
FIG. 5 is a cross-sectional view of a plunger-type flow control valve assembly according to embodiments of the present disclosure.

FIG. 5 illustrates a plunger-type flow control valve assembly 100 according to embodiments of the present disclosure. Any of the flow control devices described herein can be this plunger type of flow control valve. The assembly 100 includes a pressure-balanced plunger 112 held within a plunger containment member 114 that is shaped and sized to house the plunger 112 within an interior region of the plunger containment member 114 such that the plunger 112 is permitted to move axially within the plunger containment member 114 as shown by arrow A. When the plunger 112 is in a closed position (as in FIG. 5) with the plunger 112 toward the right, the valve assembly 100 is closed. The flow control valve assembly 100 includes a fluid port 116 through which production fluid is permitted to flow into a main bore 117 when the plunger 112 is moved to the left.

The plunger 112 has a downhole side 118 and an uphole side 120. In previous designs, the plunger 112 was exposed to pressure on the downhole side 118 which was counter balanced by a force applied to the plunger 112 to the uphole side 120 to maintain the plunger 120 in the desired position. Depending on the installation, the pressure and counter balancing forces were large. The flow control valve assembly 100 also includes a power module 124 (shown schematically) that provides power to move the plunger up and down to open and close the valve assembly 100. The present disclosure is directed to embodiments in which the pressure is balanced between the uphole side 120 and downhole side 118.

The assembly 100 includes a series of seals 122 which will permit the pressure to be applied to the uphole side 120 without contaminating the fluid flow through the fluid port 116. The uphole side 120 and downhole side 118 can both be in communication with hydrostatic pressure in the wellbore mitigating and even eliminating the need to force the plunger 112 toward the closed position. The forces required to move the plunger 112 from the closed position toward any intermediate position or a fully-open position are also very low. In some embodiments the required power is 10 watts or less. The power consumption is related to the flow rates and the pressure rating. For a lower pressure and flow rate configuration, the power can be as low as 5 watts. The balanced design allows for a greater amount of pressure to be held. In some embodiments, the pressure can be as high as 5,000 psi. The seals 122 can be made of a different material and configuration than the interface between the plunger 112 and the downhole side 118 of the plunger containment member 114, resulting in a differential force urging the plunger 112 in either direction, depending on the characteristics of the seals. The balanced design results in this resultant force being no greater than 50 pound-feet. In some embodiments the force is as much as 100 pound-feet, or as little as 20 pound-feet. Such an installation in a complex multi-zonal well installation as shown in the present disclosure was previously difficult and required power quantities greater than what was easily available.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A flow control valve assembly, comprising:

a plunger containment member configured to be disposed in a well;

a plunger operatively coupled to the plunger containment member such that moving the plunger toward an uphole side and toward a downhole side opposite the uphole side in the plunger containment member causes the flow control valve assembly to selectively open and close in response to administration of force to the plunger, wherein the plunger is continuously moveable with respect to the plunger containment member such that the flow control valve assembly can be selectively opened and closed to any intermediate position between a fully opened position and a fully closed position, wherein the uphole and downhole sides are both exposed to the same hydrostatic pressure in the well;

a first seal between the plunger and the plunger containment member on the uphole side; and a second seal between the plunger and the plunger containment member on the downhole side.

2. The flow control valve assembly of claim 1 wherein the plunger containment member comprises an axial bore within a sidewall of a completion string.

3. The flow control valve assembly of claim 1, further comprising a power module configured to provide power to move the plunger to selectively open and close the flow control valve assembly.

4. The flow control valve assembly of claim 3 wherein the power module uses no more than 10 watts.

5. The flow control valve assembly of claim 3 wherein the power module uses no more than 5 watts.

6. The flow control valve assembly of claim 3 wherein the first and second seals are configured to hold 5,000 psi with the plunger in the fully closed position.

7. The flow control valve assembly of claim 3 wherein the first and second seals are able to withstand 1,200 psi and the power module is configured to operate with between 8-10 watts.

8. The flow control valve assembly of claim 1 wherein the flow control valve assembly comprises a fluid port positioned inwardly of the plunger, the flow control valve assembly further comprising an interior bore through which fluid flows after passing through the fluid port.

9. The flow control valve assembly of claim 1 wherein the flow control valve assembly is a first flow control valve assembly operating in concert with a second flow control valve assembly.

10. The flow control valve assembly of claim 9 wherein the flow control valve assemblies are configured to be selectively opened and closed independently of one another.

11. The flow control valve assembly of claim 9 wherein fluid permitted by the open flow control valve assemblies is fluidly merged into a common bore to enable the fluid to flow upward and out of the well.

12. The flow control valve assembly of claim 1 wherein the seals are a series of redundant seals.

13. The flow control valve assembly of claim 1 wherein the first and second seals can hold 5,000 psi of pressure.

14. The flow control valve assembly of claim 1 wherein the first seal and second seal have different dimensions such that there is a differential force urging the plunger toward the uphole side or the downhole side, wherein the differential force is no greater than 50 pound-feet.

15. The flow control valve assembly of claim 1 wherein the plunger is configured to be selectively hydraulically actuated by a control module to any intermediate position between the fully opened position and the fully closed position.

16. A method for operating a flow control device, comprising:

providing a flow control valve in a well, the flow control valve having a plunger containment member, a plunger, and a fluid port, wherein the plunger is configured to travel forward and backward continuously in the plunger containment member to open and close the flow control valve and to selectively move the plunger to any intermediate position between an open position and a closed position with respect to the plunger containment member, wherein the plunger has a first side and a second side opposite the first side, wherein the first and second sides are both exposed to the same hydrostatic pressure in the well, and the fluid port is opened or closed by moving the plunger within the plunger containment member;

providing a first seal for the first side of the plunger and a second seal for the second side of the plunger, wherein the first and second seals are configured to withstand up to 1,200 psi;

operating a power module to move the plunger in the plunger containment member, wherein the power module consumes no more than 10 watts of power.

17. A flow control device for use in a downhole completion, comprising:

a central fluid bore configured to conduct fluid upward from a well, the central fluid bore having a fluid port in a wall of the central fluid bore;

a plurality of sand screens positioned outside the central fluid bore and configured to filter fluid as the fluid passes through the sand screens;

an annular bore configured to receive fluid after passing through the sand screens, wherein the annular bore is fluidly connected to the fluid port in the central fluid bore;

a plunger positioned in the annular bore and configured to selectively block fluid flow from the annular bore into the central fluid bore, wherein the plunger is selectively, continuously movable between a closed position, a fully open position, and any intermediate position therebetween, the plunger having a downhole side and an uphole side opposite the downhole side, wherein the uphole and downhole sides are both exposed to the same hydrostatic pressure in the well; and a seal assembly between the plunger and the uphole side.

18. The flow control device of claim 17, further comprising an uphole port configured to permit hydrostatic pressure to reach the uphole side of the plunger.

19. The flow control device of claim 17, further comprising a power module configured to provide power to move the plunger between the positions, wherein the power module is configured to operate the plunger using 10 watts or less, the seal assembly is configured to withstand 1,200 psi, and the plunger in the closed position is configured to withstand 1,200 psi.

* * * * *